US011453845B2

(12) United States Patent
Bautista Cid et al.

(10) Patent No.: US 11,453,845 B2
(45) Date of Patent: Sep. 27, 2022

(54) HOME CARE COMPOSITIONS

(71) Applicant: Colgate-Palmolive Company, New York, NY (US)

(72) Inventors: Oscar Bautista Cid, Mexico D.F. (MX); Erick Cardenas Alpizar, Mexico D.F. (MX); Jose Javier Tovar Pescador, Mexico D.F. (MX)

(73) Assignee: Colgate-Palmolive Company, New York, NY (US)

( * ) Notice: Subject to any disclaimer, the term of this patent is extended or adjusted under 35 U.S.C. 154(b) by 155 days.

(21) Appl. No.: 16/474,421

(22) PCT Filed: Dec. 18, 2017

(86) PCT No.: PCT/US2017/067132
§ 371 (c)(1),
(2) Date: Jun. 27, 2019

(87) PCT Pub. No.: WO2018/125647
PCT Pub. Date: Jul. 5, 2018

(65) Prior Publication Data

US 2019/0345416 A1 Nov. 14, 2019

Related U.S. Application Data

(60) Provisional application No. 62/440,097, filed on Dec. 29, 2016.

(51) Int. Cl.
*C11D 1/66* (2006.01)
*C11D 3/37* (2006.01)
(Continued)

(52) U.S. Cl.
CPC ..... *C11D 11/0017* (2013.01); *C11D 1/66* (2013.01); *C11D 3/0015* (2013.01);
(Continued)

(58) Field of Classification Search
CPC ..... C11D 1/66; C11D 3/0015; C11D 3/162; C11D 3/2086; C11D 3/37; C11D 3/373; C11D 3/3765; B08B 3/04
See application file for complete search history.

(56) References Cited

U.S. PATENT DOCUMENTS 6,004,913 A 12/1999 Iacobucci et al.
2004/0097395 A1 5/2004 Crutzen
(Continued)

FOREIGN PATENT DOCUMENTS

CN 1981025 6/2007
EP 2121887 11/2009
(Continued)

OTHER PUBLICATIONS

International Search Report and Written Opinion of the International Searching Authority in International Application No. PCT/US2017/067132, dated Feb. 16, 2018.

*Primary Examiner* — Brian P Mruk

(57) ABSTRACT

Described herein, are rinse-free laundry care compositions comprising: a surfactant scavenger; an acrylate thickening agent; and a non-ionic surfactant; wherein the non-ionic surfactant and surfactant scavenger are present in a weight ratio of from about 5:1 to about 30:1. Methods of making and using these compositions are also described.

16 Claims, 1 Drawing Sheet

(51) Int. Cl.

| | |
|---|---|
| ***B08B 3/04*** | (2006.01) |
| ***C11D 11/00*** | (2006.01) |
| ***C11D 3/00*** | (2006.01) |
| ***C11D 3/20*** | (2006.01) |
| ***C11D 17/00*** | (2006.01) |

(52) U.S. Cl.
CPC ..... *C11D 3/2086* (2013.01); *C11D 3/373* (2013.01); *C11D 3/3765* (2013.01); *C11D 17/0017* (2013.01)

(56) References Cited

U.S. PATENT DOCUMENTS

| | | | | |
|---|---|---|---|---|
| 2012/0246838 | A1* | 10/2012 | Garduno ..... | C11D 1/62<br>8/137 |
| 2016/0060573 | A1* | 3/2016 | Fossum ..... | C11D 3/373<br>8/137 |
| 2016/0130528 | A1* | 5/2016 | Si ..... | C11D 3/0026<br>510/347 |

FOREIGN PATENT DOCUMENTS

| | | | | |
|---|---|---|---|---|
| WO | 2002/072745 | | 9/2002 | |
| WO | 2006/133791 | | 12/2006 | |
| WO | 2008/110205 | | 9/2008 | |
| WO | 2013/029904 | | 3/2013 | |
| WO | WO 2013/029904 | * | 3/2013 | ..... C11D 1/835 |

* cited by examiner

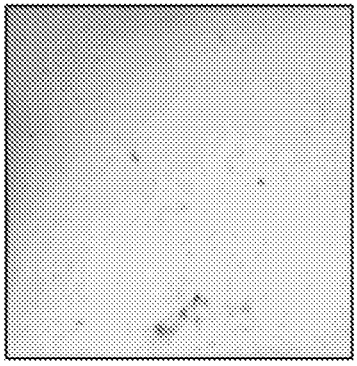
Ex. 1
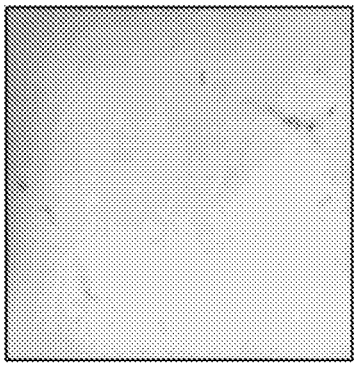
Ex. 2
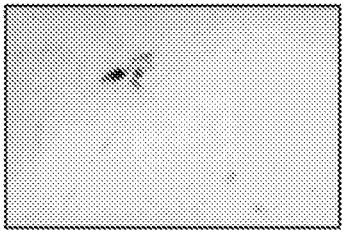
Comp. Ex. 1
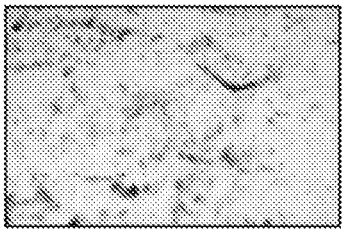
Comp. Ex. 2
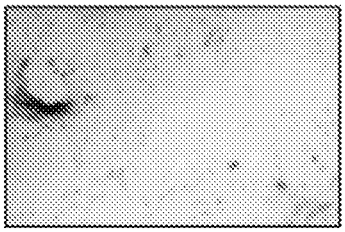
Comp. Ex. 3
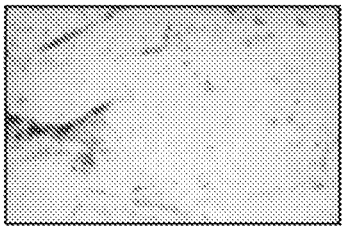
Comp. Ex. 4
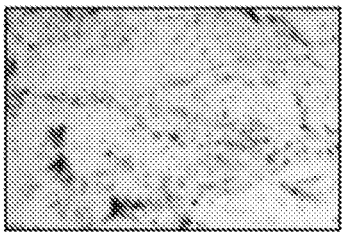
Comp. Ex. 5

HOME CARE COMPOSITIONS

CROSS-REFERENCE TO RELATED APPLICATIONS

This application claims priority to U.S. Provisional Patent Application No. 62/440,097, filed 29 Dec. 2016, which is incorporated herein by reference.

BACKGROUND

In addition to fabric softening benefits, concentrated fabric softeners generally provide more than one benefit e.g. easy of ironing, wrinkle reduction, fast dry, etc. One important benefit, especially in regions where water is scarce, is a composition that permits rinsing and conditioning in a single step without the need for extensive rinsing before the conditioning step. However, current "rinse-free" offerings usually carry residual detergent to the rinse step.

This problem of detergent carry over is even more acute with manual washing and/or washing or semi-automatic washing machine. Residual detergent is usually anionic which interacts with cationic fabric softeners during the rinse cycle to produce undesirable flocs while also carrying a significant amount of suds in the rinse solution.

As such, in order to offer a rinse free product there is a need to reduce foaming, while also reducing the formation of flocs. Some embodiments of the present invention are directed to meet these needs.

BRIEF SUMMARY

In some embodiments, the present invention provides a multifunctional rinse-free laundry care composition comprising: a surfactant scavenger; an acrylate thickening agent; and a non-ionic surfactant; wherein the non-ionic surfactant and surfactant scavenger are present in a weight ratio of from about 5:1 to about 30:1. In some embodiments, the non-ionic surfactant and surfactant scavenger are present in amounts effective to substantially eliminate flocks. Further embodiments provide a matrix for sequestering the cationic ingredients.

Other embodiments provide methods for rinsing a fabric, comprising contacting a fabric, previously washed with a detergent, with any one of the compositions described herein.

BRIEF DESCRIPTION OF THE DRAWING

FIG. 1 depicts the results of a residue formation test for two (2) exemplary compositions of the present invention and five (5) comparative compositions.

DETAILED DESCRIPTION

In some embodiments, the present invention provides a multifunctional rinse-free laundry care composition comprising: a surfactant scavenger; an acrylate thickening agent; and a non-ionic surfactant. In some embodiments, the non-ionic surfactant and surfactant scavenger are present in a weight ratio of from about 5:1 to about 30:1. In some embodiments, the non-ionic surfactant and surfactant scavenger are present in a weight ratio of about 5:1. In some embodiments, the non-ionic surfactant and surfactant scavenger are present in a weight ratio of about 28:1. In other embodiments, the non-ionic surfactant and surfactant scavenger are present in amounts effective to substantially eliminate flocs.

In some embodiments, the surfactant scavenger comprises an organofunctional silicone. In some embodiments, the surfactant scavenger is provided in the form of an emulsion. Some embodiments of the present invention provide a multifunctional rinse-free laundry care composition comprising from about 0.001 to about 0.1 wt % of said scavenger agent. Other embodiments provide a multifunctional rinse-free laundry care composition comprising from about 0.005 to about 0.05 wt % of said scavenger agent. Still further embodiments provide a multifunctional rinse-free laundry care composition comprising about 0.007 wt % of said scavenger agent. Yet other embodiments provide multifunctional rinse-free laundry care compositions comprising about 0.03 wt % of said scavenger agent. In some embodiments, the surfactant scavenger comprises a polydimethylsiloxane.

In some embodiments, the multifunctional rinse-free laundry care composition comprises from about 0.05 to about 0.5 wt % of the non-ionic surfactant. In other embodiments, the multifunctional rinse-free laundry care composition comprises from about 0.1 to about 0.25 wt % of the non-ionic surfactant. In some embodiments, the multifunctional rinse-free laundry care composition comprises about 0.150 wt % of the non-ionic surfactant. Further embodiments provide a multifunctional rinse-free laundry care composition comprising about 0.200 wt % of said non-ionic surfactant. In some embodiments, the non-ionic surfactant comprises an alkoxylated alcohol. In some embodiments, the alkoxylated alcohol is preferably an ethoxylated $C_6$-$C_{22}$ fatty alcohol having a linear or branched alkyl chain and having an average ethoxylation degree between 1-50, preferably between 1-30, more preferably between 1-15; or an ethoxylated linear or branched $C_7$-$C_{15}$ secondary alcohol, preferably ethoxylated linear $C_{11}$-$C_{15}$ alcohol having an average ethoxylation degree between 1-20, preferably between 1-15, more preferably 5-15.

In some embodiments, the multifunctional rinse-free laundry care compositions further comprise a fabric softening active ingredient. In some embodiments, the fabric softening active ingredient comprises an esterquat. Esterquats are generally understood to be quaternized fatty acid alkanolamine ester salts which, in recent years, have proven to be suitable as another group of cationic surfactants—besides the known tetraalkyl ammonium salts—for use as fabric softeners and as conditioners for cosmetics. They are normally produced by esterification of fatty acids with alkanolamines and subsequent quaternization of the alkanolamine esters with methyl chloride or dimethyl sulfate. In some embodiments, the esterquats are obtainable by esterification of a $C_6$-$C_{22}$ fatty acid with triethanolamine and subsequent quaternization, said mixture containing non-quaternized di-esteramine (di-esteramine), non-quaternized tri-esteramine (tri-esteramine), quaternized mono-esteramine (mono-esterquat), quaternized di-esteramine (di-esterquat) and quaternized tri-esteramine (tri-esterquat). In other embodiments, the esterquat comprises N,N-bis (stearoyl-oxy-ethyl) N,N-dimethyl ammonium chloride, N,N-bis(tallowoyl-oxyethyl) N,N-dimethyl ammonium chloride, N, N-bis (stearoyloxy-ethyl) N-(2-hydroxyethyl) N-methyl ammonium methyl sulfate or 1,2-di (stearoyl-oxy)-3-trimethyl ammoniumpropane chloride.

In some embodiment, the acrylate thickening agent is cationic. In some embodiments, the thickening agent is provided in the form of an emulsion.

In some embodiments, the multifunctional rinse-free laundry care composition has a viscosity of from about 100 to 550 cps.

Further embodiments provide a rinse-free laundry care composition wherein the surfactant scavenger and non-ionic surfactant are present in amounts effective to eliminate foam in less than 20 seconds in a suds suppression test. Other embodiments provide a rinse-free laundry care composition wherein the surfactant scavenger and non-ionic surfactant are present in amounts effective to eliminate foam in less than 19 seconds in a suds suppression test. Still further embodiments provide a rinse-free laundry care composition wherein the surfactant scavenger and non-ionic surfactant are present in amounts effective to eliminate foam in less than about 18 seconds in a suds suppression test.

Some embodiments provide a multifunctional rinse-free laundry care composition wherein the surfactant scavenger prevents residual detergent from interacting with a cationic ingredient.

In some embodiments, the multifunctional rinse-free laundry care composition according to any foregoing claim, further comprising from about 0.001 to about 0.1 wt % of an acidifying agent. In some embodiments, the acidifying agent comprises citric acid, lactic acid, or a combination thereof. In some embodiments, the acidifying agent is present in an amount effective to maintain the pH of the multifunctional rinse-free laundry care composition in a range of from about 1.5 to about 3.5.

Still further embodiments provide a method for rinsing fabrics comprising contacting a fabric, previously washed in a detergent liquor, with any one of the compositions described herein. In some embodiments, the rinse process may be performed manually in basin or bucket, in a non-automated washing machine, or in an automated washing machine. When hand washing is performed, the laundered fabrics are removed from the detergent liquor and wrung out. The fabric softener of the present invention is then added to fresh water and the fabrics are then, directly or after an optional inefficient first rinse step, rinsed in the water containing the composition according to the conventional rinsing habit. The fabrics are then dried using conventional means.

Some embodiments provide a method for reducing the volume of water consumed in a laundering operation in which a fabric conditioning composition is utilized, the method comprising the steps of washing the fabrics with an aqueous detergent, removing a major portion of the aqueous detergent, and rinsing the washed fabric in a rinse solution comprising any one of the compositions described herein, wherein during this rinsing step residual detergent and soil are removed from the fabrics and the fabrics are conditioned.

In some embodiments, the terms "fabric conditioning composition", "in-wash fabric conditioning composition", "rinse-fee composition", "laundry composition" and the like, are used interchangeably.

In other embodiments, the multifunctional rinse-free laundry care composition comprises from about 75 to about 95 wt % water. In other embodiments, the multifunctional rinse-free laundry care composition comprises from about 80 to about 95 wt % water. In other embodiments, the multifunctional rinse-free laundry care composition comprises from about 85 to about 95 wt % water. In other embodiments, the multifunctional rinse-free laundry care composition comprises from about 90 to about 95 wt % water.

In further embodiments, the multifunctional rinse-free laundry care composition comprises a plurality of polydimethylsiloxanes.

In some embodiments, the multifunctional rinse-free laundry care composition further comprises a chelating agent. In some embodiments, the multifunctional rinse-free laundry care composition further comprises from about 0.01 to about 0.5 wt % of a chelating agent, based upon the total weight of the composition. In some embodiments, the chelating agent comprises phosphonic acid. In some embodiments, the chelating agent may be amino tris methylene phosphonic acid.

In some embodiments, the multifunctional rinse-free laundry care composition further comprises a fragrance. In some embodiments, the fragrance comprises a combination of an organic fragrance oil and a slurry of capsules containing an organic fragrance oil. If present, the fragrance composition may be included in a ratio of 0.5:1, 1:0.5, 1:1, 2:0.5, 0.5:2, 1:3, or 3:1, based upon total weight of the fabric conditioning composition. Such fragrance capsules may be formed of a friable wall that releases an oil fragrance when broken by the agitation forces (e.g., rubbing, pressing) of the washing cycle, once the aqueous solvent media is eliminated. Examples of commercially available fragrance capsules that may be utilized with the fabric conditioning composition of the invention include those supplied by Firmenich Inc. (Plainsboro, NR), International Flavors and Fragrances Inc. (New York, N.Y.), and Givaudan (Vernier, Switzerland).

In some embodiments, the compositions of the present invention further comprise a preservative. In some embodiments, the preservative comprises a mixture of isothiazolone compounds. In some embodiments, the preservative is present in an amount effective to increase the fabric conditioning composition's stability against microorganisms.

In some embodiments, the compositions of the present invention further comprises a co-softener, e.g. a fatty alcohol, glycerol mono-stearate or glycerol mono-oleate. Other optional components commonly used in fabric softening compositions may be added in minor amounts to enhance either the appearance or performance properties of the liquid fabric softener compositions of this invention.

In some embodiments, the compositions of the preset invention further comprise a colorant. In some embodiments, the colorant is water-soluble, for example, those commercialized by Milliken & Company (Spartanburg, S.C.) under the brand name Liquitint®.

In some embodiments, the emulsion further comprises a wax. In some embodiments, the wax is a synthetic wax.

In some embodiments, the inventive compositions of the present invention comprise a matrix which sequesters the cationic ingredients of the composition. In some embodiment, the matrix is adapted to permit the cationic ingredients to provide their function, while minimizing—or preferably avoiding—any interaction with anionic ingredients, e.g. detergents or sufactants.

The compositions of the present invention can be made in accordance with conventional methods. For example, weigh the required amount of distilled water in a beaker. Add amino trimethyl phosphonic acid, and lactic acid to water and mix. Add polydimethylsiloxane polymer. Heat to 60° C. Stir the solution using an overhead stirrer at 250 RPM for 2 minutes, then add non ionic surfactant and stir for five (5) minutes. In a beaker, heat esterquat to 65° C. Add esterquat into solution while stirring at 400 RPM. Mix the solution for 10 minutes. Add SNF™ polymer into the solution and stir for 10 minutes. Check the temperature of the mixture. On cooling to room temperature, add fragrance drop wise.

Embodiments of the present invention will now be further described by way of the following, non-limiting, examples.

EXAMPLES

Example 1

Two (2) exemplary laundry care compositions (Examples 1 and 2), or Ex. 1 and Ex. 2) and five (5) comparative compositions are prepared according to the formulas set forth in Table 1 (below).

TABLE 1

| Ingredient | Ex. 1 | Ex. 2 | Comp. Ex. 1 | Comp. Ex. 2 | Comp. Ex. 3 | Comp. Ex. 4 | Comp. Ex. 5 |
|---|---|---|---|---|---|---|---|
| Water | 94.1473 | 94.1743 | 93.9643 | 94.2793 | 94.0543 | 94.2643 | 94.2643 |
| Tensapol AO-20 | — | — | 0.300 | — | — | — | — |
| D-Foam-R W-466 | 0.200 | 0.150 | — | — | 0.300 | — | — |
| Lactic Acid | 0.0625 | 0.0625 | 0.0625 | 0.0625 | 0.0625 | 0.0625 | 0.0625 |
| Acrylate thickener | 0.1964 | 0.1964 | 0.1964 | 0.1964 | 0.1964 | 0.1964 | 0.1964 |
| Tetranyl L2-92 | 4.5246 | 4.5246 | 4.5246 | 4.5246 | 4.5246 | 4.5246 | 4.5246 |
| Microbicide | 0.020 | 0.020 | 0.020 | 0.020 | 0.020 | 0.020 | 0.020 |
| Silfoam SC141 | 0.0070 | 0.0070 | — | — | — | 0.090 | — |
| SAG 4865 | — | — | — | 0.075 | — | — | — |
| Antifoam G50 | — | — | — | — | — | — | 0.090 |
| Silicone antifoam 1086 | — | — | 0.090 | — | — | — | — |
| Colorant(s), fragrance(s), etc. | QS | QS | QS | QS | QS | QS | QS |
| Total | 100 | 100 | 100 | 100 | 100 | 100 | 100 |

Example 2

Two (2) exemplary multifunctional laundry compositions comprising the inventive combination of nonionic surfactant and surfactant scavenger, and five (5) comparative laundry compositions (Comp. Ex. 1 to Comp. Ex. 5) are evaluated for residual detergent after washing in a residue formation test, as follows. 100 ml of a laundry composition is added to a vessel containing 10 liters of water and mixed. A garment is submerged and removed from the mixture five (5) times. The garment is squeezed to remove excess water and placed in a second vessel. A wet black fabric is introduced to the garment to collect residues and the results are compared. The results of these evaluations are depicted in FIG. 1.

Example 3

Two (2) exemplary multifunctional laundry compositions comprising the inventive combination of nonionic surfactant and surfactant scavenger, and five (5) comparative laundry compositions (Comp. Ex. 1 to Comp. Ex. 5) are evaluated in a suds suppression test, as follows. Four liters of water are added to a vessel. Four grams of detergent are added to the vessel and the vessel is agitated about fifty times to generate foam. The laundry composition is then added to the vessel and the time it takes for all of the foam to be eliminated, is measured. The results of the suds suppression test are provided below in Table 2.

TABLE 2

| Composition | Defoaming Time (seconds) |
|---|---|
| Ex. 1 | 18 |
| Ex. 2 | 16 |

TABLE 2-continued

| Composition | Defoaming Time (seconds) |
|---|---|
| Comp. Ex. 1 | 15 |
| Comp. Ex. 2 | 26 |
| Comp. Ex. 3 | 30 |
| Comp. Ex. 4 | 17 |
| Comp. Ex. 5 | 25 |

As illustrated in the photographs provided in FIG. 1 and the data described in Table 2, the inventive compositions of the present invention unexpectedly eliminate flocs; and at the same time, sufficiently and efficiently reduce foaming that is often associated with laundry compositions.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A multifunctional rinse-free laundry care composition comprising:

a surfactant scavenger;

an acrylate thickening agent; and a non-ionic surfactant;

a cationic fabric softening active ingredient;

wherein the non-ionic surfactant and surfactant scavenger are present in a weight ratio of from about 21:1 to about 30:1;

wherein the surfactant scavenger is present in an amount of from about 0.001 to about 0.007 wt %, based on the total weight of the composition; and wherein the non-ionic surfactant and surfactant scavenger eliminate foam in less than 20 seconds in a suds suppression test.

2. The multifunctional rinse-free laundry care composition according to claim 1, wherein the surfactant scavenger comprises an organofunctional silicone.

3. The multifunctional rinse-free laundry care composition according to claim 1, wherein the surfactant scavenger is provided in the form of an emulsion.

4. The multifunctional rinse-free laundry care composition according to claim 1, comprising from about 0.005 to about 0.007 wt % of said surfactant scavenger.

5. The multifunctional rinse-free laundry care composition according to claim 1, wherein said surfactant scavenger comprises a polydimethylsiloxane.

6. The multifunctional rinse-free laundry care composition according to claim 1, comprising from about 0.1 to about 0.25 wt % of said non-ionic surfactant.

7. The multifunctional rinse-free laundry care composition according to claim 1, wherein the fabric softening active ingredient comprises an esterquat.

8. The multifunctional rinse-free laundry care composition according to claim 1, wherein the acrylate thickening agent is cationic.

9. The multifunctional rinse-free laundry care composition according to claim 1, wherein the thickening agent is provided in the form of an emulsion.

10. The multifunctional rinse-free laundry care composition according to claim 1, having a viscosity of from about 100 to about 550 cps.

11. The multifunctional rinse-free laundry care composition according to claim 1, wherein the suds suppression test is defined in the following: four liters of water are added to a vessel; four grams of detergent are added to the vessel and the vessel is agitated about fifty times to generate foam; the laundry care composition is then added to the vessel and the time it takes for all of the foam to be eliminated, is measured.

12. The multifunctional rinse-free laundry care composition according to claim 7, wherein the surfactant scavenger prevents residual detergent from interacting with a cationic ingredient.

13. The multifunctional rinse-free laundry care composition according to claim 1, further comprising from about 0.001 to about 0.1 wt % of an acidifying agent.

14. The multifunctional rinse-free laundry care composition according to claim 13, wherein the acidifying agent comprises citric acid, lactic acid, or a combination thereof.

15. The multifunctional rinse-free laundry care composition according to claim 13, wherein the acidifying agent is present in an amount effective to maintain the pH of the multifunctional rinse-free laundry care composition in a range of from about 1.5 to about 3.5.

16. A method for rinsing fabrics comprising contacting a fabric, previously washed in a detergent liquor, with a composition according to claim 1.

* * * * *